US006422035B1

(12) United States Patent
Phillippe

(10) Patent No.: US 6,422,035 B1
(45) Date of Patent: Jul. 23, 2002

(54) HEAT EXCHANGED SYSTEM EFFICIENCY ENHANCING DEVICE

(76) Inventor: Gary M. Phillippe, 6720 Stoneman Dr., North Highlands, CA (US) 95660

( * ) Notice: Subject to any disclaimer, the term of this patent is extended or adjusted under 35 U.S.C. 154(b) by 0 days.

(21) Appl. No.: 09/659,011

(22) Filed: Sep. 8, 2000

(51) Int. Cl.[7] ..... F25B 39/04; F25B 41/04
(52) U.S. Cl. ..... 62/509; 62/117
(58) Field of Search ..... 62/117, 196.4, 62/509

(56) References Cited

U.S. PATENT DOCUMENTS 3,134,241 A * 5/1964 Johnson ..... 62/196.4
3,368,364 A * 2/1968 Norton et al. ..... 62/196.4 X
4,457,138 A * 7/1984 Bowman ..... 62/509 X

* cited by examiner

*Primary Examiner*—William Wayner
(74) *Attorney, Agent, or Firm*—James M. Ritchey

(57) ABSTRACT

For use with a heat exchange system having a compressor, condenser, evaporator, refrigerant, and refrigerant carrying lines, an efficiency enhancing apparatus that includes a refrigerant cooling module positioned in the heat exchange system between the compressor and the condenser. The refrigerant cooling module comprises a secondary condenser that draws and cools a portion of the refrigerant from a main refrigerant carrying line exiting the compressor, thereby leaving a remaining portion of non-cooled refrigerant in the main refrigerant carrying line and a refrigerant siphoning and mixing vessel having inlet ports for receiving both the drawn and cooled portion of the refrigerant and the non-cooled portion of the refrigerant and a refrigerant exit port leading from the mixing vessel to the primary condenser for carrying mixed and cooled refrigerant.

10 Claims, 2 Drawing Sheets

HEAT EXCHANGED SYSTEM EFFICIENCY ENHANCING DEVICE

BACKGROUND OF THE INVENTION

1. Field of the Invention

A device for enhancing the efficiency of a heat exchange or refrigeration system is disclosed. The invention relates to a modified and improved refrigerant recycling heat exchange system or a retrofit alteration to an existing heat exchange system that enhances the system's efficiency by slightly cooling and thereby liquefying a portion of the hot gas refrigerant prior to the main condenser. More particularly, the subject efficiency enhancing system is a "parallel-flow desuperheater" that comprises a secondary hot line that removes some of the hot gas refrigerant in the main hot refrigerant gas line and carries it to a "desuperheater" condenser that produces cool liquid refrigerant that is returned, via siphon action, back into the main hot refrigerant gas in a mixing vessel to generate a cooled saturated vapor, thereby increasing the efficiency of the system by requiring less energy to compress the resulting refrigerant.

2. Description of the Background Art

Various devices relying oh standard refrigerant recycling technologies have been available for many years. Refrigeration and heat exchange devices, having both cooling and heating capabilities, are included within the general scheme of the subject invention, however, the subject device relates preferably to refrigeration systems. Within the limits of each associated design specification, heat exchange devices enable a user to cool or heat a selected environment or with a refrigeration unit to cool a desired location. For these heating and cooling duties, in general, gases or liquids are compressed, expanded, heated, or cooled within an essentially closed system to produce a desired temperature result in the selected environment.

Traditional sub-coolers partially cool the refrigerant prior to the expansion device and subsequent evaporator. Such refrigerant cooling has been shown to increase the efficiency of the heat transfer within the evaporator. Various types of sub-coolers exist, but the most common form cools the refrigerant by drawing in cooler liquid to surround the warmer refrigerant.

The foregoing information reflects the state of the art of which the applicant is aware and is tendered with the view toward discharging applicant's acknowledged duty of candor in disclosing information which may be pertinent in the examination of this application. It is respectfully submitted, however, that this information does not teach or render obvious applicants' claimed invention.

SUMMARY OF THE INVENTION

An object of the present invention is to provide a device for increasing the efficiency of a heat exchange system and in particular a refrigeration system.

Another object of the present invention is to disclose a device that cools a portion of the hot refrigerant that exits the compressor in a refrigeration system and then mixes the cooled portion with the non-cooled portion and transfers the mixture to the main condenser, thereby increasing efficiency.

A further object of the present invention is to relate a efficiency enhancing device that may be added to an existing heat exchange system or fabricated into the heat exchange system during its initial construction.

Still another object of the present invention is to supply a device that increases efficiency of a standard heat exchange system by utilizing a secondary condenser and mixing vessel, wherein a portion of the hot refrigerant is withdrawn after the compressor and cooled and then mixed with the non-cooled portion by a siphoning action just before passage into the primary condenser.

Disclosed for use with a heat exchange or refrigeration system having a compressor, condenser, evaporator, refrigerant, and refrigerant carrying lines, is an efficiency enhancing apparatus. The subject apparatus comprises a refrigerant cooling module positioned in the heat exchange system between the compressor and the condenser. The refrigerant cooling module comprises a secondary condenser that draws and cools a portion of the refrigerant from a main refrigerant carrying line exiting the compressor, thereby leaving a remaining portion of non-cooled refrigerant in the main refrigerant carrying line. Following the secondary condenser is a refrigerant siphoning and mixing vessel having means for receiving both the drawn and cooled portion of the refrigerant and the non-cooled portion of the refrigerant and a refrigerant exit port leading from the mixing vessel to the condenser for carrying the mixed refrigerant. Specifically, the refrigerant receiving means in the refrigerant mixing vessel comprises a first refrigerant inlet port for receiving the drawn and cooled portion of the refrigerant and a second refrigerant inlet port for receiving the non-cooled portion of the refrigerant. More specifically, the-refrigerant siphoning and mixing vessel comprises a central container having first and second ends, the first refrigerant inlet port for receiving the drawn and cooled portion of in the refrigerant positioned proximate the container first end, the second refrigerant inlet port for receiving the non-cooled portion is of the refrigerant positioned proximate the container first end, and the refrigerant exit port positioned proximate the container second end. Usually included are means for contacting surrounding air with the refrigerant cooling module. Primarily, the means for contacting surrounding air is either an existing fan already found in the existing system or an additional fan.

Other objects, advantages, and novel features of the present invention will become apparent from the detailed description that follows, when considered in conjunction with the associated drawings.

DESCRIPTION OF THE PREFERRED EMBODIMENT

Figure 1:
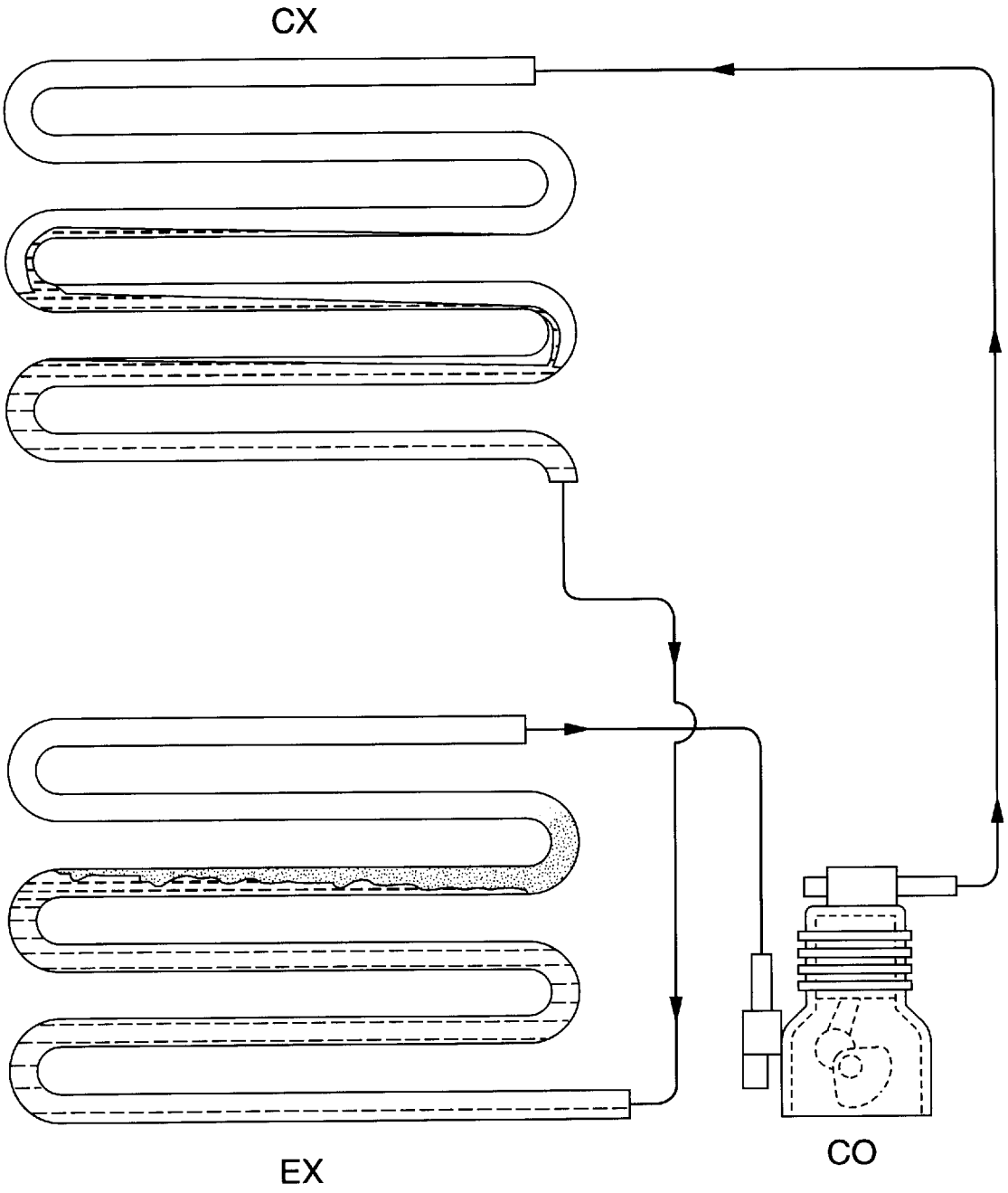
FIG. 1 (Prior Art)
FIG. 1 is a schematic diagram of the components in a standard prior art heat exchange system.

It must be noted that even though a particular configuration for a refrigeration system is utilized in the figures and detailed description of the subject invention, any equivalent heat exchange; system can be fitted or adapted with the subject device. For reference purposes, FIG. 1 depicts a generalized "Prior Art" heat exchange system. To quickly appreciate the benefits of the subject device, a brief description of the functioning of a traditional heat exchange system is supplied. An expandable-compressible refrigerant is contained and cycled within an essentially enclosed system comprised of various liquid/gas refrigerant manipulating components. When a liquid refrigerant expands (within a heat exchanger or evaporator) to produce a gas it increases its heat content at the expense of a first surrounding environment which decreases in temperature. The heat rich refrigerant is transported to a second surrounding environment and the heat content of the expanded refrigerant released to the second surroundings via condensation (within a heat exchanger or condenser), thereby increasing the temperature of the second surrounding environment. For a heat exchange, heating or cooling conditions are generated in the first and second environments, by reversing the process within the enclosed system.

As indicated, FIG. 1 depicts a traditionally refrigeration configured system, but, again, it must be stressed that the subject invention is suitable for modifying any equivalent heat exchange system in an analogous manner. In addition to the necessary plumbing (liquid/gas lines, conduits, tubing, or pipes) to connect the constituent components, the three basic components in all systems are: a compressor CO; a condenser (heat exchanger) CX; and an evaporator (heat exchanger) EX. These components are the same regardless of the size of the system, but may contain additional elements depending on need and usage or usage location. Gaseous refrigerant is compressed by the compressor CO and transported to the condenser CX which causes the gaseous refrigerant to liquefy. The liquid refrigerant is transported to the expansion valve (not shown) and permitted to expand gradually into the evaporator EX (usually by means of an expansion valve, not shown). After evaporating into its gaseous form, the gaseous refrigerant is moved to the compressor CO to repeat the cycle.

A lower compression ratio reflects a higher system efficiency and consumes less energy during operation. During compression the refrigerant gas pressure increases and the refrigerant gas temperature increases. When the gas temperature/pressure of the compressor is greater than that of the condenser, gas will move from the compressor to the condenser. The amount of compression necessary to move the refrigerant gas through the compressor is called the compression ratio. The higher the gas temperature/pressure on the condenser side of the compressor, the greater the compression ratio. The greater the compression ratio the higher the energy consumption. Further, the energy (Kw) necessary to operate a cooling or heat exchange system is primarily determined by three factors: the compressor's compression ratio; the refrigerant's condensing temperature; and the refrigerant's flow characteristics. The compression ratio is determined by dividing the discharge pressure (head) by the suction pressure. Any change in either suction or discharge pressure will change the compression ratio.

The condensing temperature is the temperature at which the refrigerant gas will condense to a liquid, at a given pressure. Well known standard tables relate this data. In the FIG. 1traditional example, using R22 refrigerant, that pressure is 226 PSIG. This produces a condensing temperature of 110° F. At 110° F., each pound of liquid freon that passes into the evaporator will absorb 70.052 Btu's. However, at 90° F. each pound of freon will absorb 75.461 Btu's. Thus, the lower the temperature of the liquid refrigerant entering the evaporator the greater its ability to absorb heat. Each degree that the liquid refrigerant is lowered increases the capacity of the system by about one-half percent. The subject invention works by generating this lowered refrigerant temperature.

Figure 2:
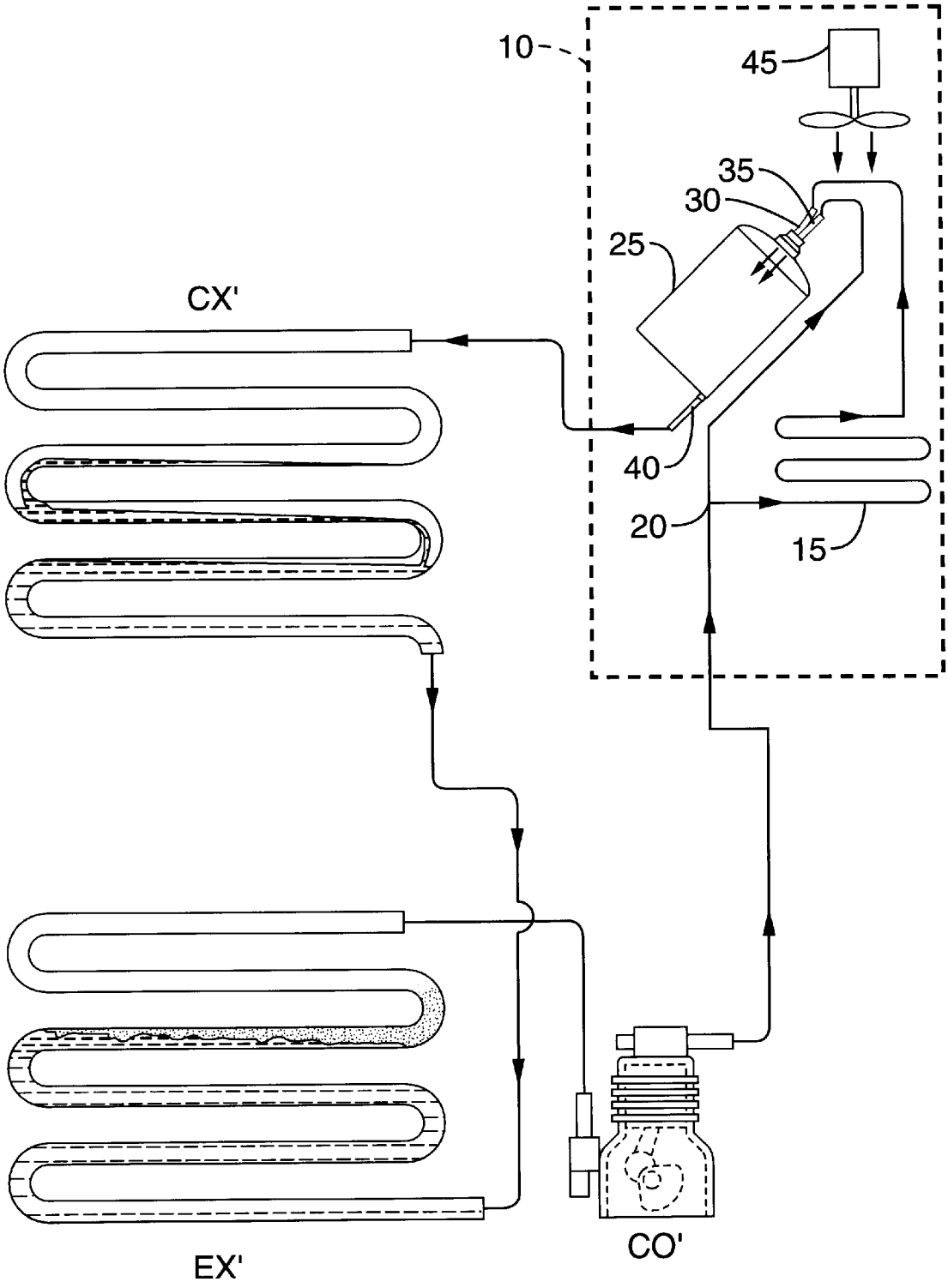
FIG. 2 is a schematic diagram showing a; heat exchange system adapted with the subject invention.

Referring now to FIG. 2, there is shown a preferred embodiment of the subject device 10 fitted into a traditional refrigeration system. The primes denote equivalent features (CO'=compressor; CX'=condenser; and EX'=evaporator), but with the subject invention fitted into the heat exchange system between the compressor CO' and the condenser CX'. The subject system comprises a secondary condenser 15 of refrigerant conduit or line that receives a portion of the refrigerant from a connection 20 into the main refrigerant line. The connection 20 permits a limited portion of the hot refrigerant to pass through the secondary condenser 15, thereby cooling to a temperature less than that of the refrigerant that remains in the main hot refrigerant line. After the secondary condenser 15 cools the portion of refrigerant that passes through it, that cooled refrigerant is transferred to a mixing vessel 25 through a first inlet port 30 in the vessel 25. Also, the non-cooled refrigerant from the main refrigerant line enters the mixing vessel 25 at a second inlet port 35. The cooled refrigerant is siphoned into the mixing vessel 25-as the non-cooled refrigerant flows in. The cooled and non-cooled refrigerants mix in the mixing vessel 25 and are returned to the main condenser CX' via the exit port 40 in the mixing vessel 25. Although the mixing vessel 25 is shown in FIG. 2 as being "tipped" or angled from the vertical, as long as satisfactory mixing and collection of the incoming refrigerants is accomplished in the mixing vessel 25, other equivalent configuration,are considered to be within the realm of this disclosure.

Usually, means are provided for drawing air over the secondary condenser. Preferably, the air drawing means comprises a fan 45 or its equivalent. The subject invention may be configured so that the fan 45 may be the original fan utilized in the standard heat exchange system (thereby cooling both the primary condenser CX' and the secondary condenser 15) or an added fan utilized just for cooling the secondary condenser 15. Therefore, the conduit, piping, or line comprising the secondary condenser 15 may be a separate entity, housed either completely separate from or with the original system (perhaps inside the original system housing), or formed with, near, or along side the line comprising the primary condenser CX'. Thus, the subject invention may be an add-on unit that is utilized to adapt an existing heat exchange system or it may be incorporated into a heat exchange system in its initial fabrication.

Clearly, the exact sizes of the various subject invention components will vary with the sizes of the components within the primary system to which it is associated. Efficiency for any particular adapted system may be altered by adjusting such items as: component sizes; the amount of refrigerant removed for cooling in the secondary condenser; the amount of air drawn over the cooling components; and the like.

The subject invention causes less energy usage during operation of the modified heat exchange system by because the separated or secondary stream of refrigerant is cooled and returned, by siphoning not a Venturi Effect (the siphoning occurs since the returned cooled secondary refrigerant and the gaseous main refrigerant differ little in pressure, usually only about 3 lbs), to the main stream of refrigerant, thereby enhancing efficiency. By way of example and not by way of limitation, typically, the secondary refrigerant stream cools from approximately 185° F. to 195° F. to about 150° F. to 160° F. during its passage through the subject invention, which results in about a 10% to 20% enhancement in efficiency for the system. As indicated, the siphoning method of the subject invention is not a Venturi Effect, which would cause the compressor head pressure to go too high and decrease efficiency.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. For use with a heat exchange system having a compressor, condenser, evaporator, refrigerant, and refrigerant carrying lines, an efficiency enhancing apparatus comprising a refrigerant cooling module positioned in the heat exchange system between the compressor and the condenser, wherein said refrigerant cooling module comprises:

a) a secondary condenser that transfers and cools a portion of the refrigerant from a main refrigerant carrying line exiting the compressor, thereby leaving a remaining portion of non-cooled refrigerant in said main refrigerant carrying line and b) a refrigerant mixing vessel having means for simultaneously receiving both said transferred and cooled portion of the refrigerant and said non-cooled portion of the refrigerant and a -refrigerant exit port leading from said mixing vessel to the condenser for carrying mixed refrigerant.

2. An apparatus according to claim 1, wherein said refrigerant receiving means in said refrigerant mixing vessel comprises a first refrigerant inlet port for receiving said transferred and cooled portion of the refrigerant and a second refrigerant inlet port for receiving said non-cooled portion of the refrigerant.

3. An apparatus according to claim 2, wherein said refrigerant mixing vessel comprises:

a) a central container having first and second ends;

b) said first refrigerant inlet port for receiving said transferred and cooled portion of the refrigerant positioned proximate said container first end;

c) said second refrigerant inlet port for receiving said non-cooled portion of the refrigerant positioned proximate said container first end; and d) said refrigerant exit port positioned proximate said container second end.

4. An apparatus according to claim 1, further comprising means for contacting surrounding air with said refrigerant cooling module.

5. An apparatus according to claim 4, wherein said means for contacting surrounding air is selected from a group consisting of an existing fan already found in the heat exchange system and an additional fan.

6. For use with a heat exchange system having a compressor, condenser, evaporator, refrigerant, and refrigerant carrying lines, an efficiency enhancing apparatus comprising a refrigerant cooling module positioned in the heat exchange system between the compressor and the condenser, wherein said refrigerant cooling module comprises:

a) a secondary condenser that transfers and cools a portion of the refrigerant from a main refrigerant carrying line exiting the compressor, thereby leaving a remaining portion of non-cooled refrigerant in said main refrigerant carrying line;

b) a refrigerant mixing vessel, for simultaneously receiving both said transferred and cooled refrigerant portion and said non-cooled refrigerant portion, having a first refrigerant input port for receiving said transferred and cooled portion of the refrigerant and a second refrigerant input port for receiving said non-cooled portion of the refrigerant and a refrigerant exit port leading from said mixing vessel to the condenser for carrying mixed refrigerant; and c) means for contacting surrounding air with said refrigerant cooling module.

7. An apparatus according to claim 6, wherein said refrigerant mixing vessel comprises:

a) a central container having first and second ends;

b) said first refrigerant inlet port for receiving said transferred and cooled portion of the refrigerant positioned proximate said container first end;

c) said second refrigerant inlet port for receiving said non-cooled portion of the refrigerant positioned proximate said container first end; and d) said refrigerant exit port positioned proximate said container second end.

8. An apparatus according to claim 6, wherein said means for contacting surrounding air is selected from a group consisting of an existing fan already found in the heat exchange system and an additional fan.

9. For use with a heat exchange system having a compressor, condenser, evaporator, refrigerant, and refrigerant carrying lines, an efficiency enhancing apparatus comprising a refrigerant cooling module positioned in the heat exchange system between the compressor and the condenser, wherein said refrigerant cooling module comprises:

a) a secondary condenser that transfers and cools a portion of the refrigerant from a main refrigerant carrying line exiting the compressor, thereby leaving a remaining portion of non-cooled refrigerant in said main refrigerant carrying line;

b) a refrigerant mixing vessel having a first refrigerant input port for receiving said transferred and cooled portion of the refrigerant and a second refrigerant input port for receiving said non-cooled portion of the refrigerant and a refrigerant exit port leading from said mixing vessel to the condenser for carrying mixed refrigerant; and c) a fan for contacting surrounding air with said refrigerant cooling module, wherein said fan is selected from a group consisting of a first fan already present in the heat exchange system and a second fan added to the heat exchange system.

10. An apparatus according to claim 9, wherein said refrigerant mixing vessel comprises:

a) a central container having first and second ends;

b) said first refrigerant inlet port for receiving said transferred and cooled portion of the refrigerant positioned proximate said container first end;

c) said second refrigerant inlet port for receiving said non-cooled portion of the refrigerant positioned proximate said container first end; and d) said refrigerant exit port positioned proximate said container second end.

* * * * *